US006883996B2

(12) United States Patent
Ishida

(10) Patent No.: US 6,883,996 B2
(45) Date of Patent: Apr. 26, 2005

(54) WRITING INSTRUMENT

(75) Inventor: Nobuo Ishida, Nara (JP)

(73) Assignee: Kuretake Co., Ltd., Nara (JP)

( * ) Notice: Subject to any disclaimer, the term of this patent is extended or adjusted under 35 U.S.C. 154(b) by 34 days.

(21) Appl. No.: 10/703,339

(22) Filed: Nov. 7, 2003

(65) Prior Publication Data

US 2004/0114986 A1 Jun. 17, 2004

(30) Foreign Application Priority Data

Aug. 11, 2002 (JP) ..... 2002-325497

(51) Int. Cl.[7] ..... B43K 5/00
(52) U.S. Cl. ..... 401/206; 401/205; 401/198
(58) Field of Search ..... 401/198, 205, 401/206, 232, 235, 263, 264, 270

(56) References Cited

U.S. PATENT DOCUMENTS 3,468,611 A * 9/1969 Ward ..... 401/186
4,693,623 A * 9/1987 Schwartzman ..... 401/206
6,406,205 B1 * 6/2002 Hu ..... 401/205
6,497,527 B1 * 12/2002 Kaufmann ..... 401/198
6,641,320 B1 * 11/2003 Ballot et al. ..... 401/206

FOREIGN PATENT DOCUMENTS

JP 10-157379 6/1998
WO WO 01/30510 A1 5/2001

* cited by examiner

*Primary Examiner*—David J. Walczak
(74) *Attorney, Agent, or Firm*—Gerald E. Hespos; Anthony J. Casella

(57) ABSTRACT

A writing instrument has a felt pen core held in a leading holder at the leading end of a pen shaft. The pen core is movable along the longitudinal direction of the pen shaft and is pressed in the longitudinal direction to supply ink stored in an ink storage chamber inside the pen shaft to the pen core. A base end portion includes a projection with a tapered outer side surface that narrows the projection in the tail direction. The projection is lower than an engaging portion and is movable along the longitudinal direction between the engaging portion and the leading end of the pen shaft. A notch is formed in a base-end surface of the base end portion and extends in the upper direction. The projection undergoes an elastic deformation to narrow the width of the notch, thereby narrowing a maximum width of the projection.

12 Claims, 5 Drawing Sheets

WRITING INSTRUMENT

BACKGROUND OF THE INVENTION

1. Field of the Invention

The present invention relates to a writing instrument such as a felt pen.

2. Description of the Related Art

Conventionally, writing instruments using a core made of a fabric such as a felt as in a felt pen have been generally such that ink stored in an ink storage chamber is supplied to the pen core by pressing the pen core (see, for example, Japanese Unexamined Patent Publication No. H10-157379.) One example of such writing implements is described with reference to FIG. 4.

A writing implement 100 includes a pen core 5 which is so held in a leading holder 4 provided at the leading end of a pen shaft 3 as to be movable along a longitudinal direction, and a valve 6 movable along the longitudinal direction as the pen core 5 is pressed or freed from a pressed state. The supply of ink from an ink storage chamber 2 to the pen core 5 is controlled by opening and closing an ink flowing passage 10 coupled to the pen core 5 by means of the valve 6.

This pen core 5 is pressed into the leading holder 4 and held therein by a frictional force created by the pressing contact of the outer circumferential surface of the pen core 5 and the inner circumferential surface of the leading holder 4, and a base-end 52 thereof is in contact with the valve 6. Further, the valve 6 is so held as to be movable along the longitudinal direction by a holding member 7, and a pressing spring 8 for biasing the valve 6 toward the leading end of the pen shaft 3 is also held in the holding member 7. The valve 6 is moved in directions toward and away from a valve seat 91 (inner wall of the ink flowing passage 10) to bring a jaw portion 61 into contact with and away from the valve seat 91, thereby opening and closing the ink flowing passage 10. Although not shown, the holding member 7 is formed with an opening to communicate the inside and outside of the holding member 7, and the ink in the ink storage chamber 2 has entered the holding member 7.

In this writing instrument 100, the jaw portion 61 of the valve 6 is separated from the valve seat 91 to open the ink flowing passage 10 and supply the ink to the pen core 5 as shown in FIG. 5 as the pen core 5 is slid along the longitudinal direction upon being pressed. Further, by canceling such a pressed state, the jaw portion 61 of the valve 6 is so moved as to come into contact with the valve seat 91, thereby closing the ink flowing passage 10. Consequently, the pen core 5 is also slid in the leading direction along the longitudinal direction. Thus, a suitable amount of the ink can be supplied to the pen core 5 by pressing the pen core 5 and freeing it from the pressed state.

In this construction, the pen core 5 is held in pressing contact with the inner circumferential surface of the leading holder 4 so as to be securely slidable in order to supply a suitable amount of the ink to the pen core 5.

However, if the pen core 5 is repeatedly slid by being pressed and being freed from the pressed state, a clearance between the pen core 5 and the leading holder 4 is widened by a sectional area of the pen core 5 gradually reduced by a friction or the like occurring between the pen core 5 and the inner circumferential surface of the leading holder 4, and the pen core 5 is made unable to be brought into contact with the leading holder 4 by a reduced frictional resistance between the outer circumferential surface of the pen core 5 and the inner circumferential surface of the leading holder 4 when the pen core 5 absorbs the ink, thereby making the pen core 5 unable to come into pressing contact with the leading holder 4. Therefore, there has been a danger that the pen core 5 comes out of the leading holder 4.

As a method for preventing the pen core 5 from coming out, it can be thought to increase the sectional area of the pen core 5 to hold the outer circumferential surface of the pen core 5 and the inner circumferential surface of the leading holder 4 in pressing contact with a lager force. However, in such a case, a larger force is required to press the pen core 5 into the leading holder 4, thereby hindering a smooth fitting operation of the pen core 5. Further, the pen core 5 may be damaged by a force exerted upon being pressed into the leading holder 4. Even if the pen core 5 is properly pressed into, an excessive press-contact force may hinder a smooth operation.

In other words, quite a strict dimensional control for fitting is required to accomplish both a secure holding of the pen core 5 and smooth movements of the pen core 5 in the conventional writing instrument. It is difficult to carry out such a dimensional control for the pen core made of, e.g. a felt. Thus, productivity is accordingly reduced, thereby raising a problem in reducing production costs.

SUMMARY OF THE INVENTION

It is an object of the present invention to provide a writing instrument which is free from the problems residing in the prior art.

It is another object of the present invention to provide a writing instrument which can prevent a pen core from coming out of a leading holder over a long period.

According to an aspect of the invention, a writing instrument is provided with a pen shaft having a leading holder at a leading end thereof, a pen core placed in the leading holder, an ink storage chamber formed in the pen shaft for storing ink, a valve operable to be in contact with the pen core for allowing the ink to flow to the pen core when the pen core is applied with a pressure in a tail direction, and keeping the ink from flowing to the pen core when the pen core is applied with no pressure.

The pen core is movable in the leading holder along the longitudinal direction of the pen shaft, and is formed with a projection on a base end thereof. The projection extends in a direction normal to the longitudinal direction of the pen shaft.

The leading holder is formed with an engaging portion operable to come into contact with the projection of the pen core. The engaging portion extends inward from an inner circumferential surface of the leading holder.

The writing instrument can improve productivity and reduce production costs by realizing a secure holding and smooth movements while obviating the need for a strict dimensional control, despite repeated movements of the pen core along a longitudinal direction.

These and other objects, features and advantages of the present invention will become more apparent upon a reading of the following detailed description and accompanying drawings.

DETAILED DESCRIPTION OF THE PREFERRED EMBODIMENTS

A preferred embodiment of the present invention is described with reference to FIGS. 1 and 2. It should be appreciated that the present invention is not limited to the embodiments described below. In the following description, a "leading direction" means a direction in which a pen core projects from a leading holder (upper side in FIGS. 1 and 2) and a "tail direction" means a direction opposite from the "leading direction" (lower side in FIGS. 1 and 2).

Figure 1:
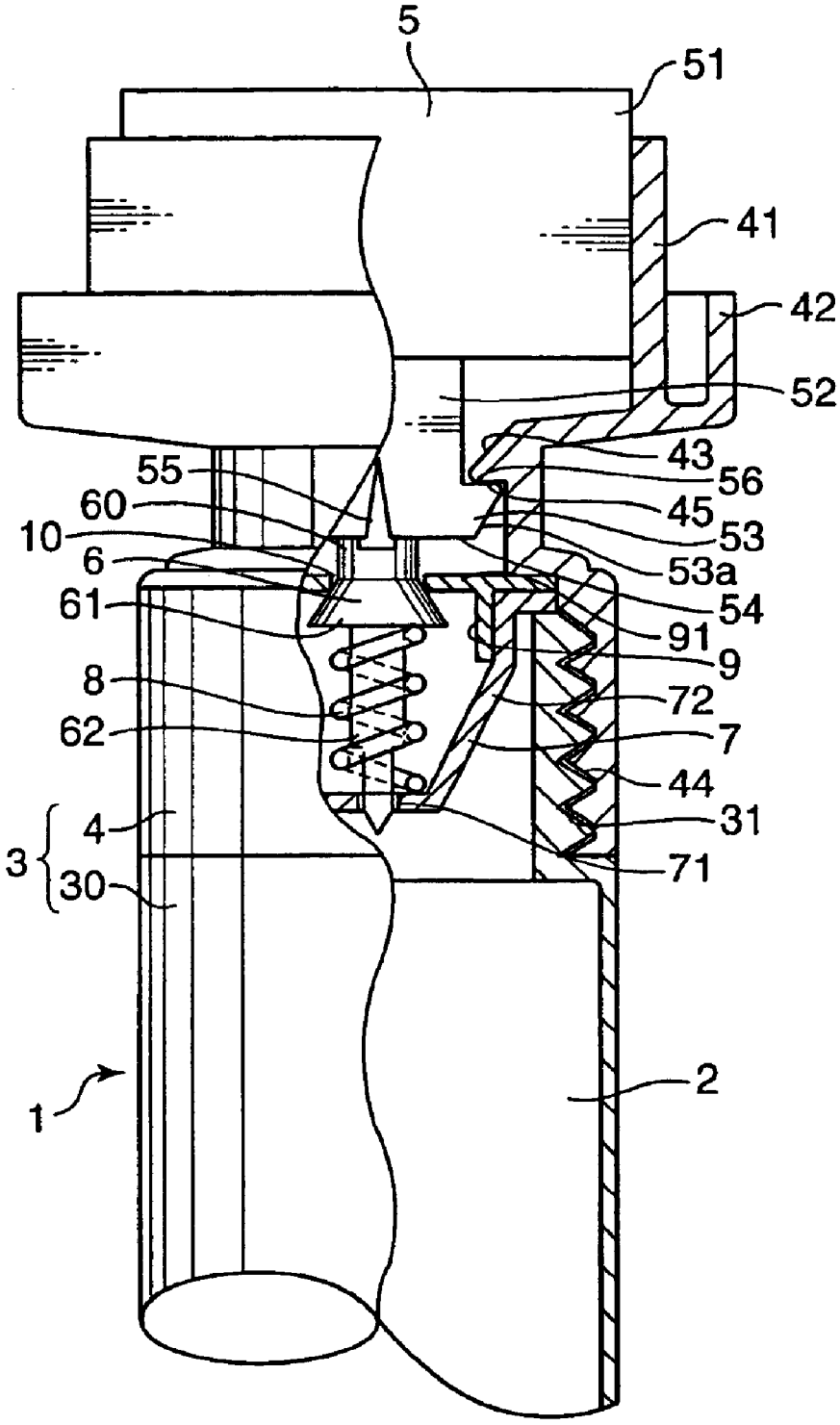
FIG. 1 is a front view partly in section of a writing instrument according to an embodiment of the invention, showing a state where an ink flowing passage is closed by a valve.
Figure 2:
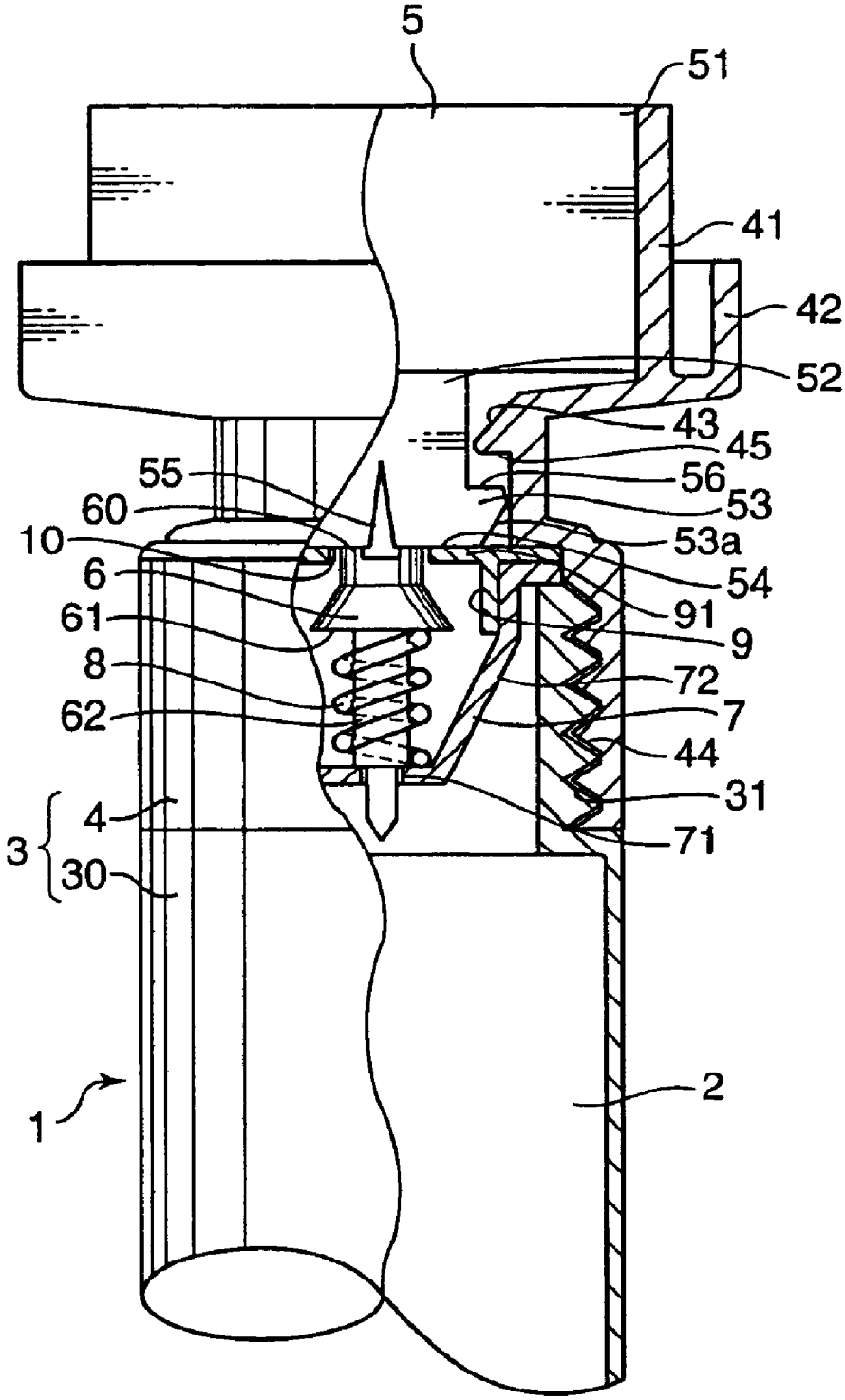
FIG. 2 is a front view partly in section of the writing instrument, showing a state where the ink flowing passage is opened by the valve.

Referring to FIGS. 1 and 2, a writing instrument 1 is comprised of a pen shaft 3 having a leading holder 4 mounted at the leading end of a shaft main body 30 thereof, and a pen core 5 mounted at the leading end of the leading holder 4. The pen core 5 is fitted into an inner wall 41 of the leading holder 4 and so held in the leading holder 4 as to be movable along the longitudinal direction of the pen shaft 3 in the inner wall 41.

The shaft main body 30 of the pen shaft 3 includes an ink storage chamber 2 formed inside and an externally threaded portion 31 formed on the outer circumferential surface of the leading end thereof for engagement with the leading holder 4, and one end thereof is open. At this open end, a valve 6 for opening and closing an ink flowing passage 10 coupled to the pen core 5, a holding member 7 for holding the valve 6, and a valve seat member 9 are provided.

The holding member 7 holds the valve 6 and a pressing spring 8 (to be described later) such that the valve 6 is movable along the longitudinal direction of the pen shaft 3, is in the form of a cap open in the leading direction and fixed to the leading end of the shaft main body 30. A though hole 71 is formed in the bottom of the holding member 7, so that a main shaft 62 of the valve 6 is insertable therethrough. An unillustrated opening is formed in a side wall 72 of the holding member 7 to communicate the inside of the holding member 7 and the ink storage chamber 2 via this opening.

The valve seat member 9 is engaged at the leading end of the holding member 7 and is formed with a bore so that a leading end 60 of the valve 6 can project therethrough. The inner circumferential surface of this bore serves as a valve seat 91, and this bore functions as the ink flowing passage 10 through which ink is supplied from the ink storage chamber 2 to the pen core 5 via the inside of the holding member 7.

The valve 6 is in the form of a shaft and includes a leading-end portion 60, a jaw portion 61 and the main shaft 62. The leading-end portion 60 has a smaller diameter than the valve seat 91 so as to be insertable through the valve seat 91 as described above. The jaw portion 61 has a larger diameter than the valve seat 91, so that the jaw portion 61 is brought into contact with the valve seat 91 to close the ink flowing passage 10. The main shaft 62 has a smaller diameter than the through hole 71 at least at its base end, which is insertable through the through hole 71 as described above.

The pressing spring 8 formed by a compression coil spring is mounted on the main shaft 62. The opposite ends of the pressing spring 8 are in contact with the jaw portion 61 and the holding member 7, respectively, and the valve 6 is constantly biased toward the pen core 5 (in the leading direction of the pen shaft 3) by an elastic force of the pressing spring 8. The valve 6 is held such that the jaw portion 61 thereof is in contact with the valve seat 91 by being biased by the pressing spring 8, and is normally held in such a state as to close the ink flowing passage 10 to stop the supply of the ink to the pen core 5. The valve 6 is slidable along the longitudinal direction of the pen shaft 3 (vertical direction in FIGS. 1 and 2) by fitting the main shaft 62 thereof through the through hole 71 and fitting the leading-end portion 60 thereof through the valve seat 91. As the pen core 5 is pressed in the tail direction of the pen shaft 3, the valve 6 is moved in the tail direction against the biasing force of the pressing spring 8 to separate the jaw portion 61 from the valve seat 91, and is moved to a position where it opens the ink flowing passage 10.

The leading holder 4 holds the pen core 5 in such a manner as to be movable along the longitudinal direction, and includes the inner wall 41, an outer wall 42, an engaging portion 43 and an internally threaded portion 44.

The engaging portion 43 and the internally threaded portion 44 are formed on the inner circumferential surface of the inner wall 41, and the internally threaded portion 44 is engaged with the externally threaded portion 31 of the pen shaft 3. The engaging portion 43 projects toward the inner side of the inner wall 41 such that its projecting amount gradually increases toward the base-end with respect to the longitudinal direction, and a contact surface 45 substantially normal to the longitudinal direction is formed at a most base-end of the engaging portion 43, and is engageable with a contact surface 56 of a projection 53 of the pen core 5 as described later. The outer wall 42 is arranged around the inner wall 41 while being spaced apart therefrom by a specified distance. A cap (not shown) is mounted between the inner wall 41 and the outer wall 42.

The pen core 5 includes a penpoint 51 and a base end portion 52. The penpoint 51 is a portion to be directly brought into contact with a writing medium (e.g. paper, board) to write on the writing medium, and the size thereof is arbitrarily set according to a need. The base end portion 52 has the projection 53, a base-end surface 54 and a notch 55. The projection 53 has such an outer side surface 53*a* as to project in a direction normal to the longitudinal direction and to be shaped to gradually reduce its projecting amount toward the base-end, and the width of the base end portion 52 on its leading end surface is wider than at least a portion of the inner wall 41 where the engaging portion 43 is provided, so that this part of the base end portion 52 is engageable with the engaging portion 43 of the leading holder 4. In FIGS. 1 and 2, the contact surface 56 substantially normal to the longitudinal direction is formed at the leading end of the projection 53 with respect to the longitudinal direction, and is engaged with the contact surface 45 of the engaging portion 43. The notch 55 is formed to be tapered from the base end surface 54 in the leading direction (V-shaped in FIGS. 1 and 2), i.e. extends in a direction normal to the projecting direction of the projection 53. The projection 53 is so elastically deformable to reduce the width of the notch 55 by exerting compressing forces from the opposite ends of the base end surface 54.

The pen core 5 is held into the leading holder 4 as follows. The pen core 5 is pressed into the leading holder 4 in the tail direction, and the projection 53 passes the engaging portion 43 to be located more toward the base end than the engaging portion 43. Upon pressing the pen core 5, the compressing forces are exerted from the opposite ends of the base-end surface 54 when the projection 53 passes the engaging portion 43, thereby reducing the projecting amount of the projection 53 and elastically deforming the projection 53 (this state is not shown) such that the width of the notch 55 is narrowed. After the projection 53 passes the engaging portion 43, the projection 53 and the notch 55 are restored to their original shapes.

The pen core 5 is movable along the longitudinal direction between a position where the projection 53 is in contact with the engaging portion 43 and a position where the base-end surface 54 is in contact with the valve seat member 9. At least the pen core 5 is held in contact with the inner wall 41 of the leading holder 4, thereby preventing the pen core 5 from shaking. The pen core 5 is biased in the leading direction by the pressing spring 8 by the contact of the base end surface 54 thereof and the leading end portion 60 of the valve 6. In FIG. 1, the contact surface 56 of the projection 53 is engaged with the engaging portion 43, whereby the pen core 5 is prevented from moving in the leading direction any further.

The pen core 5 is pressed in the tail direction in the state of FIG. 1, whereby the valve 6 opens the ink flowing passage 10 as shown in FIG. 2. Hereafter, this state is described with reference to FIG. 2.

The base end portion 52 of the pen core 5 has moved in the tail direction from the state of FIG. 1 (state where the projection 53 is engaged with the engaging portion 43) to bring the base end surface 54 into contact with the valve seat member 9. Simultaneously, the valve 6 moves in the tail direction along the longitudinal direction away from the valve seat 91 while compressing the pressing spring 8 against the biasing force of the pressing spring 8. In the other words, the ink flowing passage 10 is opened. In this state, the ink flowing into the holding member 7 from the ink storage chamber 2 is supplied to the pen core 5 via the ink flowing passage 10. Since the notch 55 is formed in the base-end surface 54 of the pen core 5, a contact area with the ink having passed through the ink flowing passage 10, i.e. the surface area increases, with the result that the ink can be more efficiently supplied to the pen core 5.

Further, by canceling the pressed state, the pressing spring 8 is released from the compressed state and the valve 6 and the pen core 5 are moved in the leading direction by the biasing force of the pressing spring 8. The jaw portion 61 of the valve 6 comes into contact with the valve seat 91 to hinder any further movement of the valve 6 in the leading direction. The pen core 5 is also hindered from moving in the leading direction by the contact of the contact surface 56 of the projection 53 with the contact surface 45 of the engaging portion 43. Thus, the writing instrument 1 returns to the state shown in FIG. 1, where the ink flowing passage 10 is closed and the supply of the ink in the ink storage chamber 2 to the pen core 5 is hindered.

Specifically, the pen core 5 and the valve 6 are moved in the tail direction and returned in the leading direction by pressing the pen core 5 and freeing the pen core 5 from the pressed state, whereby the amount of ink supplied to the pen core 5 is properly adjusted.

A state when the pen core 5 is pressed into the leading holder 4 is described below. First, the pen core 5 is pressed into the leading holder 4 until the projection 53 of the pen core 5 comes into contact with the engaging portion 43 of the leading holder 4. The pen core 5 continues to be pressed until the projection 53 passes the engaging portion 43. At this time, since the projection 53 projects in the direction normal to the longitudinal direction and the outer side surface 53*a* thereof is shaped to gradually reduce its projecting amount toward the base end, a narrow portion of the projection 53 at the base end first comes into contact with the engaging portion 43 and then a wider portion thereof gradually comes into contact with the engaging portion 43. Further, since the notch 55 is so formed in the base-end surface 54 of the pen core 5 as to extend in the leading direction and substantially normal to the projecting direction of the projection 53 and the projection 53 can undergo such an elastic deformation as to narrow the width of the notch 55, a maximum width of the projection 53 is narrowed by the elastic deformation when the projection 53 passes the engaging portion 43. After the projection 53 passes the engaging portion 43 and is pressed to be located lower than the engaging portion 43, the notch 55 is restored to its original shape before the elastic deformation from the aforementioned narrowed state, whereby the projection 53 is permitted to come into contact with the engaging portion 43.

In the writing instrument 1 thus constructed, the outer side surface 53*a* of the projection 53 projects in the direction normal to the longitudinal direction and is shaped such that its projecting amount gradually decreases toward the base end, and the projection 53 is made easily elastically deformable by the shape of the notch 55. Thus, the projection 53 can pass inside the engaging portion 43 in the tail direction without any problem even if the projection 53 projects to a large extent. Therefore, the pen core 5 can be smoothly mounted into the leading holder 4 without damaging the pen core 5.

After the projection 53 passes inside the engaging portion 43, the contact surface thereof substantially normal to the longitudinal direction comes into contact with the engaging portion 43 from the lower position, whereby the pen core 5 is securely prevented from coming out of the leading holder 4 in the leading direction. Unlike the conventional construction of holding the pen core 5 only by the frictional force created by the pressing contact of the pen core 5 and the engaging portion 4, the pen core 5 can be prevented from coming out of the leading holder 4 even if the sectional area of the pen core 5 becomes slightly smaller or a frictional resistance between the outer circumferential surface of the pen core 5 and the leading holder 4 is reduced.

Further, since the pen core 5 is prevented from coming out of the leading holder 4 regardless of whether or not the outer circumferential surface of the pen core 5 is held in pressing contact with the leading holder 4, the pen core 5 does not come out of the leading holder 4 even if being formed slightly smaller due to a dimensional tolerance. Accordingly, no strict dimensional tolerance is required for the engagement of the pen core 5 and the leading holder 4, which leads to an improved productivity and an advantage in reducing production costs.

Since the contact surface normal to the longitudinal direction is formed at the leading end of the projection 53 of the pen core 5 with respect to the longitudinal direction and comes into contact with the engaging portion 43 from the lower position, a resistance created upon causing the projection 53 to pass the engaging portion 43 of the leading holder 4 in the leading direction is larger. Thus, a possibility that the pen core 5 comes out of the leading holder 4 can be further reduced.

Further, since the engaging portion 43 is formed at its most base end with the contact surface 45 substantially normal to the longitudinal direction, the resistance created upon causing the projection 53 to pass the engaging portion 43 of the leading holder 4 in the leading direction is larger. Thus, the possibility that the pen core 5 comes out of the leading holder 4 can be further reduced.

The present invention is not limited to the foregoing embodiment, but may be changed as the following modifications. In the modifications, no repeated description is given by identifying the same elements as those of the previous embodiment by the same reference numerals.

The shape of the notch 55 is not necessarily limited to the V-shape. Any desired shape can be taken in addition to a U-shape shown in FIG. 3.

Figure 3:
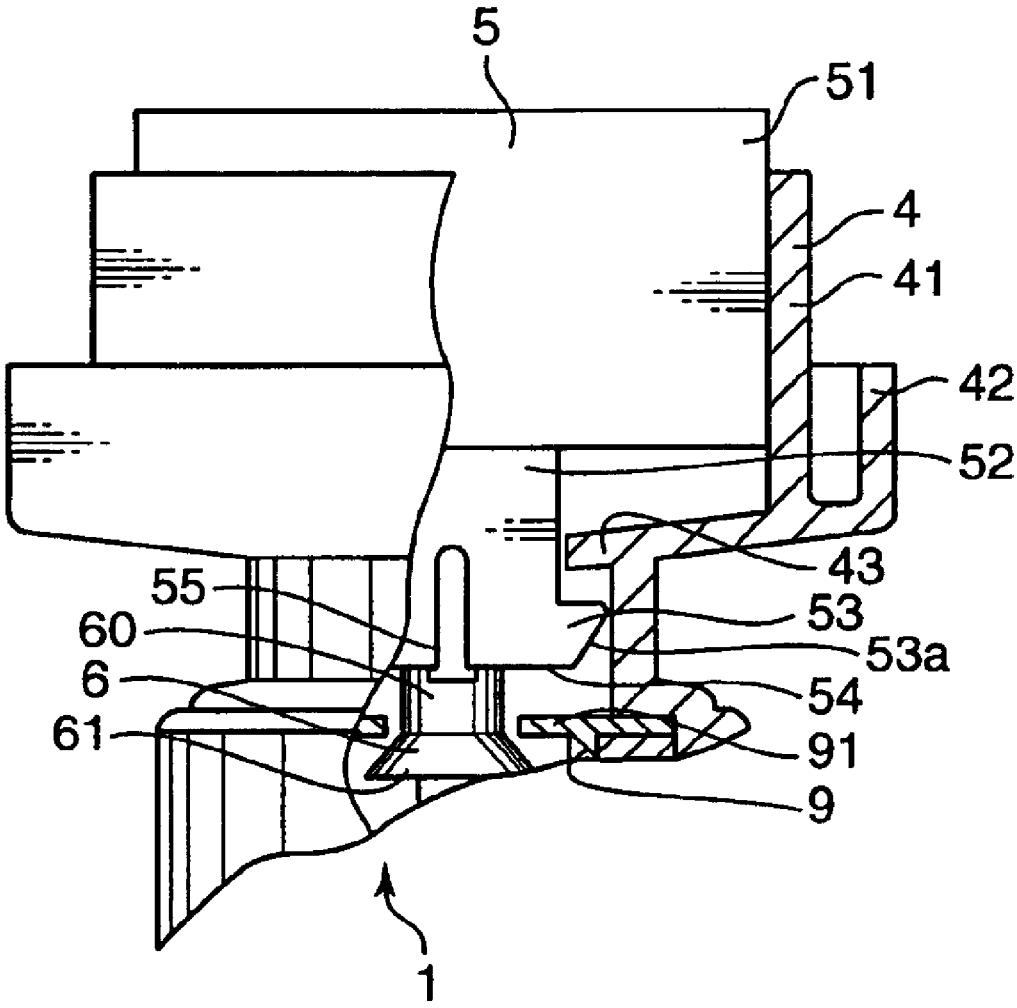
FIG. 3 is a front view partly in section of a writing instrument according to another embodiment of the invention.
Figure 4:
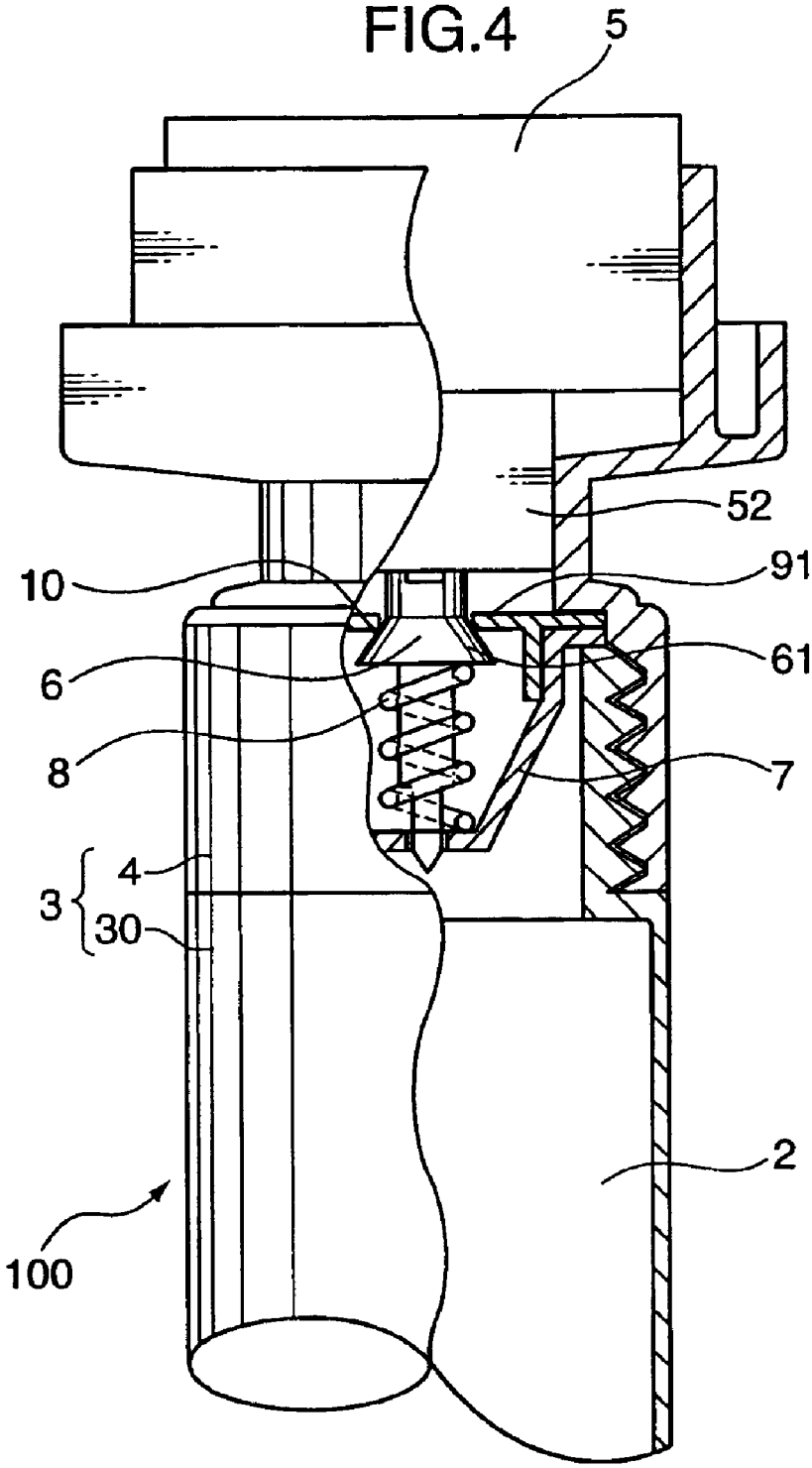
PRIOR ART FIG.4
FIG. 4 is a front view partly in section of a prior art writing instrument, showing a state where an ink flowing passage is closed by a valve.
Figure 5:
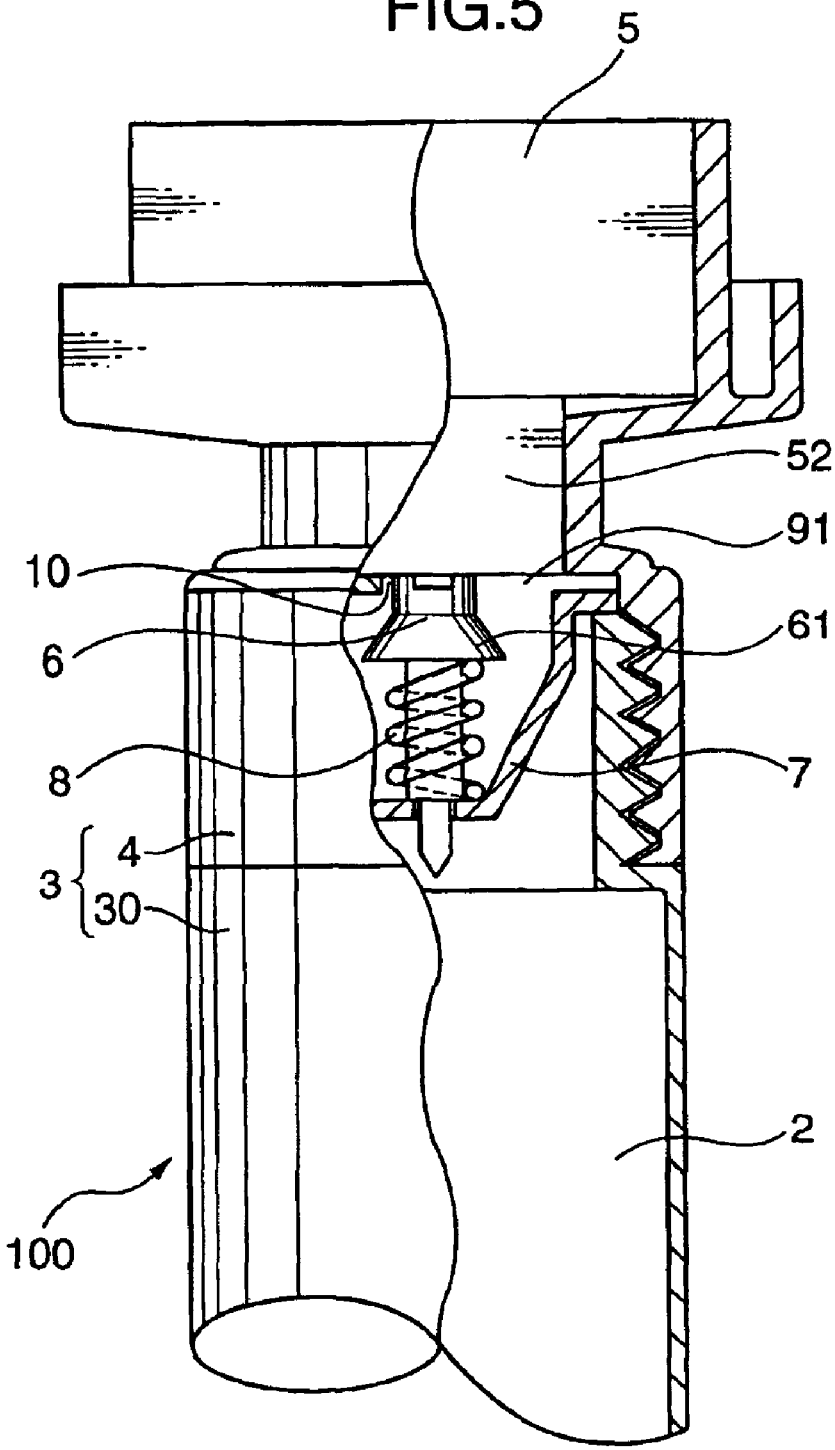
PRIOR ART FIG.5
FIG. 5 is a front view partly in section of the prior art writing instrument, showing a state where the ink flowing passage is opened by the valve.

The engaging portion 43 needs not always be so formed as to project more toward the base end with respect to the longitudinal direction. For example, as shown in FIG. 3, the engaging portion 43 may be formed into a circumferentially extending rib. However, in view of easiness to fix the pen core 5 in the leading holder 4, the engaging portion 43 is preferably formed to project more toward the base end with respect to the longitudinal direction. Further, in view of preventing the pen core 5 from coming out of the leading holder 4, the contact surface 45 substantially normal to the longitudinal direction is preferably formed at the most base end of the engaging portion 43.

The pen core 5 needs not always be made movable along the longitudinal direction between the position where the projection 53 thereof is in contact with the engaging portion 43 and the position where the base-end surface 54 is in contact with the valve seat member 9. The movable range of the pen core 5 is not particularly restricted provided that the pen core 5 is at least movable to a position located lower than the position where the projection 53 is in contact with the engaging portion 43. For example, there may be adopted such a construction that a projection is provided on the inner surface of the inner wall 41 at a position lower than the engaging portion 43 and the base-end surface 54 of the pen core 5 comes into contact with this projection.

It is not always necessary to form the notch 55. However, if the notch 55 is formed, the projection 53 can be so compressed as to reduce its projecting amount upon passing the engaging portion 43 and can also undergo such an elastic deformation as to narrow the width of the notch 55. Thus, the projection 53 can more smoothly pass the engaging portion 43 if the notch 55 is formed.

As described above, an inventive writing instrument comprises a pen shaft having a leading holder at a leading end thereof, a pen core made of fibers and placed in the leading holder, the pen core being movable in the leading holder along the longitudinal direction of the pen shaft, an ink storage chamber formed in the pen shaft for storing ink, a valve operable to be in contact with the pen core for allowing the ink to flow to the pen core when the pen core is applied with a pressure in a tail direction, and keeping the ink from flowing to the pen core when the pen core is applied with no pressure.

The ink stored in an ink storage chamber inside the pen shaft is supplied to the pen core by the pen core being pressed in the tail direction while being fitted in the leading holder and the supply of the ink being hindered by canceling the pressed state of the pen core.

The pen core is provided on a side surface of its base end with a projection having such an outer side surface as to project in a direction normal to the longitudinal direction. The projection is shaped to gradually reduce its projecting amount toward a base end thereof with respect to the longitudinal direction.

Also, an engaging portion which can be brought into contact with the projection of the pen core projects inward from the inner circumferential surface of the leading holder. Thereby, the projection can pass inside the engaging portion in the tail direction while undergoing such an elastic deformation as to reduce the projecting amount thereof, and can come into contact with the engaging portion from the lower position while being restored from the elastic deformation after passing the engaging portion, whereby the pen core is prevented from coming out of the leading holder in the leading direction and is movable along the longitudinal direction from a contact position where the projection is in contact with the engaging portion to a specified position lower than the contact position.

In this case, the projection of the pen core can smoothly pass the engaging portion upon fitting the pen core into the leading holder since having the side surface shaped to gradually reduce the projecting amount thereof toward the base end with respect to the longitudinal direction.

Further, while being located lower than the engaging portion of the leading holder after the pen core is fitted into the leading holder, the projection of the pen core is in contact with the engaging portion from the lower position, thereby being hindered from moving in the leading direction. Thus, a movement of the pen core in the leading direction of the pen shaft can be hindered with the projection engaged with the engaging portion even if the outer circumferential surface of the pen core is not necessarily held in pressing contact with the inner circumferential surface of the leading holder. Therefore, the pen core can be prevented from coming out of the leading holder even if the sectional area of the pen core becomes slightly smaller or a frictional resistance between the outer circumferential surface of the pen core and the inner circumferential surface of the leading holder is reduced due to the repeated movements of the pen core.

It is not always necessary to hold the outer circumferential surface of the pen core and the inner circumferential surface of the leading holder in pressing contact. It is sufficient to engage the pen core with the leading holder to such an extent that the shake of the pen core caused upon writing does not adversely affect the writing. In other words, the sectional area of the pen core needs not be dimensioned such that the pen core will be held in pressing contact with the leading holder. Thus, unlike the prior art, no such strict dimensional tolerance as to secure the movements of the pen core while ensuring the pressing contact between the pen core and the leading holder is not required for the engagement of the pen core and the leading holder. This leads to an improved productivity and an advantage in reducing production costs.

Preferably, a notch is so formed in a base end surface of the pen core as to extend in the leading direction, and the projection can pass inside the engaging portion from the leading end while undergoing such an elastic deformation as to reduce the width of the notch and can come into contact with the engaging portion while being restored from the elastic deformation after passing the engaging portion, whereby the pen core is prevented from coming out of the leading holder in the leading direction.

In such a case, the projection of the pen core can more smoothly pass the engaging portion since undergoing such an-elastic deformation as to narrow the width of the notch upon fitting the pen core into the leading holder. Further, as compared to a case where the notch is not formed, the projection of the pen core can pass the engaging portion even if it projects to a larger extent. Therefore, the pen core can be more securely prevented from coming out with the projection restored from the elastic deformation.

Preferably, the notch of the pen core is so formed as to extend in a direction substantially normal to a projecting direction of the projection of the pen core. With such a notch, the projection can undergo such an elastic deformation as to narrow the width of the notch.

Further preferably, a contact surface substantially normal to the longitudinal direction is formed at a leading end of the projection of the pen core with respect to the longitudinal direction and comes into contact with the engaging portion from the lower position. With such an arrangement, the projection is difficult to elastically deform when the contact surface thereof is in contact with the engaging portion from the lower position, thereby increasing a resistance created when the projection passes the engaging portion of the pen shaft. Therefore, a possibility that the pen core comes out of the leading holder is further reduced.

The specified position is, for example, a position where a base end surface of the pen core is in contact with a portion projecting from the inner circumferential surface of the pen shaft lower than the engaging portion of the pen shaft.

In this way, the projection of the pen core can smoothly pass the engaging portion upon fitting the pen core into the leading holder. After the pen core is fitted into the leading holder and the projection is restored from the elastic deformation, the pen core is prevented from coming out of the leading holder even if being repeatedly moved. Thus, the pen core can be easily fixed in the leading holder and prevented from coming out of the leading holder.

Upon the fitting the pen core into the leading holder, the projection of the pen core undergoes such an elastic deformation as to narrow the width of the notch, whereby the projection can more smoothly pass the engaging portion. As compared to a case where no notch is formed, the projection can pass the engaging portion even if it projects to a larger extent, with the result that the pen core can be more securely prevented form coming out with the projection restored from the elastic deformation. Further, since the surface area of the base-end surface of the pen core is increased by forming the notch, the ink can be more efficiently supplied to the pen core.

This application is based on patent application No. 2002-325497 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A writing instrument comprising:

a pen shaft having a leading holder at a leading end thereof;

a pen core placed in the leading holder, the pen core being movable in the leading holder along the longitudinal direction of the pen shaft;

an ink storage chamber formed in the pen shaft for storing ink;

a valve operable to be in contact with the pen core for allowing the ink to flow to the pen core when the pen core is applied with a pressure in a tail direction, and keeping the ink from flowing to the pen core when the pen core is applied with no pressure;

wherein:

the pen core is formed with a projection on a base end thereof, the projection extending in a direction normal to the longitudinal direction of the pen shaft; and the leading holder is formed with an engaging portion operable to come into contact with the projection of the pen core, the engaging portion extending inward from an inner circumferential surface of the leading holder, the engaging portion being operable to engage with the projection of the pen core to thereby prevent the pen core from coming out of the leading holder; and the projection is shaped to gradually reduce its projecting amount as advancing in the tail direction.

2. A writing instrument comprising:

a pen shaft having a leading holder at a leading end thereof;

a pen core placed in the leading holder, the pen core being movable in the leading holder along the longitudinal direction of the pen shaft;

an ink storage chamber formed in the pen shaft for storing ink;

a valve operable to be in contact with the pen core for allowing the ink to flow to the pen core when the pen core is applied with a pressure in a tail direction, and keeping the ink from flowing to the pen core when the pen core is applied with no pressure;

wherein:

the pen core is formed with a projection on a base end thereof, the projection extending in a direction normal to the longitudinal direction of the pen shaft; and the leading holder is formed with an engaging portion operable to come into contact with the projection of the pen core, the engaging portion extending inward from an inner circumferential surface of the leading holder, the engaging portion being operable to engage with the projection of the pen core to thereby prevent the pen core from coming out of the leading holder; and the pen core is elastically deformable and is formed with a notch extending halfway from the base end thereof such that the pen core is deformed to reduce the projecting amount of the projection and narrow the width of the notch when the pen core is inserted into the leading holder.

3. A writing instrument according to claim 2, wherein the projection is formed with a contact surface substantially normal to the longitudinal direction on a leading end thereof, the contact surface being operable to come into contact with the engaging portion.

4. A writing instrument according to claim 2, wherein the pen core is movable between the engaging portion and a position where the base end surface of the pen core is in contact with a portion projecting from an inner circumferential surface of the pen shaft at position lower than the engaging portion of the pen shaft.

5. A writing instrument according to claim 2, wherein the notch extends in a direction substantially normal to a projecting direction of the projection.

6. A writing instrument according to claim 5, wherein the projection is formed with a contact surface substantially normal to the longitudinal direction on a leading end thereof, the contact surface being operable to come into contact with the engaging portion.

7. A writing instrument according to claim 6, wherein the pen core is movable between the engaging portion and a position where the base end surface of the pen core is in contact with a portion projecting from an inner circumferential surface of the pen shaft at position lower than the engaging portion of the pen shaft.

8. A writing instrument according to claim 5, wherein the pen core is movable between the engaging portion and a position where the base end surface of the pen core is in contact with a portion projecting from an inner circumferential surface of the pen shaft at position lower than the engaging portion of the pen shaft.

9. A writing instrument according to claim 2, wherein the notch is tapered from the base end surface of the pen core to be V-shaped in cross-section.

10. A writing instrument according to claim 1, wherein the projection is formed with a contact surface substantially normal to the longitudinal direction on a leading end thereof, the contact surface being operable to come into contact with the engaging portion.

11. A writing instrument according to claim 10, wherein the pen core is movable between the engaging portion and a position where the base end surface of the pen core is in contact with a portion projecting from an inner circumferential surface of the pen shaft at position lower than the engaging portion of the pen shaft.

12. A writing instrument according to claim 1, wherein the pen core is movable between the engaging portion and a position where the base end surface of the pen core is in contact with a portion projecting from an inner circumferential surface of the pen shaft at position lower than the engaging portion of the pen shaft.

* * * * *